US007025233B2

(12) United States Patent
Masuda

(10) Patent No.: US 7,025,233 B2
(45) Date of Patent: Apr. 11, 2006

(54) FLUID DISCHARGE PUMP FOR DISCHARGING FLUID STORED INSIDE FLUID STORING PORTION

(76) Inventor: Masatoshi Masuda, 2, 9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 346 days.

(21) Appl. No.: 10/619,010

(22) Filed: Jul. 14, 2003

(65) Prior Publication Data

US 2004/0055457 A1 Mar. 25, 2004

(30) Foreign Application Priority Data

Jul. 24, 2002 (JP) ..... 2002-214621

(51) Int. Cl.
*B65D 47/34* (2006.01)

(52) U.S. Cl. ..... 222/321.9; 222/207; 222/209; 222/633; 222/321.7

(58) Field of Classification Search ..... 222/321.9, 222/321.7, 383.3, 385, 209, 207, 633, 632; 417/472

See application file for complete search history.

(56) References Cited

U.S. PATENT DOCUMENTS 4,220,264 A * 9/1980 Gamadia ..... 222/207
4,589,573 A * 5/1986 Tada ..... 222/153.13
4,732,549 A 3/1988 von Schuckmann ..... 417/472
4,846,372 A * 7/1989 von Schuckmann ..... 222/136
4,858,788 A * 8/1989 Meckenstock ..... 222/207
4,863,070 A * 9/1989 Andris ..... 222/207
4,915,601 A 4/1990 von Schuckmann ..... 417/472
5,014,881 A * 5/1991 Andris ..... 222/207
5,152,434 A 10/1992 Birmelin ..... 222/207
5,306,125 A * 4/1994 Weag ..... 417/472
5,320,291 A * 6/1994 Glover et al. ..... 239/708
5,518,147 A * 5/1996 Peterson et al. ..... 222/153.07
5,664,703 A 9/1997 Reifenberger et al. ..... 222/207
6,805,267 B1 * 10/2004 Bougamont ..... 222/633

FOREIGN PATENT DOCUMENTS

EP 340724 A2 * 11/1989
FR 2 564 153 A 11/1985
JP 03-000655 1/1991
JP 2001-82321 A1 3/2001

* cited by examiner

*Primary Examiner*—Patrick Brinson
(74) *Attorney, Agent, or Firm*—Knobbe, Martens Olson & Bear LLP

(57) ABSTRACT

A liquid discharge pump possesses a resinous bellows material 6, a resinous inflow valve mechanism 4, a resinous outflow valve mechanism 5, a first pressing portion 11 which moves a valve portion in the outflow valve mechanism 5 to open the inflow valve mechanism when a nozzle head 2 is pressed, and a second pressing portion 12 which presses the bellows material 6 from a stretched position to a folded-up position when the nozzle head 2 is pressed.

17 Claims, 15 Drawing Sheets

FLUID DISCHARGE PUMP FOR DISCHARGING FLUID STORED INSIDE FLUID STORING PORTION

BACKGROUND OF THE INVENTION

The present invention relates to a fluid discharge pump for discharging a fluid stored inside a fluid-storing portion from a nozzle head by pressing the nozzle head set up above the fluid-storing portion.

Regarding this type of fluid discharge pump, conventionally, a fluid discharge pump possessing a nozzle head for discharging a liquid, a fluid-storing portion for storing the liquid, a cylinder set up above the liquid storing portion, a piston which can reciprocate inside the cylinder by pressing the nozzle head, an inflow valve mechanism for letting the liquid stored in the liquid storing portion flow into the cylinder with an ascending motion of the piston, and an outflow valve mechanism for letting the liquid flowed out to the nozzle head with an descending motion of the piston has been used.

In this type of conventional fluid discharge pump, the outer circumferential surface of the piston and the inner circumferential surface of the cylinder need to be manufactured with a high degree of accuracy because the piston needs to be able to reciprocate smoothly inside the cylinder. As a result, production costs become high. Additionally, in this type of fluid discharge pump, inflow motions and outflow motions need to be executable reliably while the inflow and outflow valve mechanisms have a simple configuration.

SUMMARY OF THE INVENTION

The present invention has been achieved to solve the above-mentioned problems and aims to provide a fluid discharge pump which can discharge a fluid accurately while its production costs are low and its configuration is simple.

The present invention includes, but is not limited to, the following embodiments. Solely for the sake of understanding some embodiments of the present invention easily, reference numerals used in the figures explained later are referred to. However, the present invention is not limited to the structures defined by these reference numerals, and any suitable combination of elements indicated by these reference numerals can be accomplished.

In an embodiment, a fluid discharge pump (e.g., 1, 1', 101) for discharging a fluid stored inside a fluid-storing portion (e.g., 3) may comprise: (i) a nozzle head (e.g., 2, 2', 102) through which a fluid is discharged, said nozzle head being provided with a first pushing portion (e.g., 11, 51) and a second pushing portion (e.g., 12, 12', 52); (ii) an intermediate portion (e.g., 20, 120) slidably connected to the nozzle head, said intermediate portion comprising an outflow valve mechanism (e.g., 5, 105) which opens when being pressed downward, wherein when the nozzle head is pressed downward, the first pushing portion presses the outflow mechanism to open; (iii) an inflow valve mechanism (e.g., 4, 104) which opens when being pressed upward; and (iv) bellows (e.g., 6, 106) connecting the outflow valve mechanism and the inflow valve mechanism, wherein when the nozzle head is further pressed after the outflow valve mechanism is open, the second pushing portion pushes the intermediate portion downward to deform the bellows from a stretched position to a folded-up position, and wherein when the nozzle head is released, the bellows is restored from the folded-up position to the stretched position whereby the inflow valve mechanism is open and a fluid flows into the bellows.

In an embodiment, the outflow valve mechanism may comprise (I) a valve seat (e.g., 42, 53) having an opening portion (e.g., 43, 56) through which the fluid flows, and (II) a valve body (e.g., 41, 60) comprising a ring-shaped supporting portion (e.g., 45, 61), a valve portion (46, 62) for closing and opening the opening portion, and multiple coupling portions (e.g., 47, 63) connecting said supporting portion and said valve portion, said supporting portion being disposed upstream of the valve seat, wherein the first pushing portion pushes the valve portion downward to move the valve portion away from the valve seat when the nozzle head is pressed. Similarly, the inflow valve mechanism may comprise (I) a valve seat (e.g., 32, 54) having an opening portion (e.g., 33, 57) through which the fluid flows, and (II) a valve body (e.g., 31, 60) comprising a ring-shaped supporting portion (e.g., 35, 61), a valve portion (e.g., 36, 62) for closing and opening the opening portion, and multiple coupling portions (e.g., 37, 63) connecting said supporting portion and said valve portion, said supporting portion being disposed downstream of the valve seat. In an embodiment, the valve seat (e.g., 42) may be integrally formed with the intermediate portion.

In another embodiment, the bellows may be restored from the folded-up position to the stretched position by its own elastic force. Alternatively, a spring (e.g., 26) can be used which restores the bellows from the folded-up position to the stretched position.

In the above, the first pushing portion, the outflow valve mechanism, the bellows, and the inflow valve mechanism may preferably be disposed co-axially.

As to the first pushing portion, it (e.g., 11) may be hollow and constitute a part of a fluid passage (e.g., 128). Further, the first pushing portion may comprise an annular flange (e.g., 27) extending to an inner wall (e.g., 127) of the intermediate portion, wherein a fluid downstream of the outflow valve mechanism is in contact with the annular flange, the inner wall of the intermediate portion (e.g., 127), and an interior of the first pushing portion (e.g., 128'). Alternatively, the first pushing portion may be a stick-like member (e.g., 51). Further, the pump may further comprise second bellows (e.g., 55) connected to the outflow valve mechanism and an inner wall (e.g., 151) of the nozzle head, wherein a fluid downstream of the outflow valve mechanism is in contact with the second bellows and the inner wall of the nozzle head.

In an embodiment, the inflow valve mechanism may be connected to a housing (e.g., 19, 119) adapted to be connected to a liquid dispensing port of the fluid-storing portion. In the above, the valve seat is integrally formed with the housing.

Further, the intermediate portion may be slidable along an inner wall of the second pushing portion (e.g., 112, 112').

Additionally, the outflow valve mechanism, the outflow valve mechanism, and the bellows in particular may preferably be made of a resin, although all elements used can be made of a resin.

In another aspect of the present invention, a fluid-storing container (e.g., 3) comprises a container (e.g., 15) having a fluid dispensing port (e.g., 115), and a fluid discharge pump described above (any elements described above can be used in combination with other elements) attached to the fluid dispensing port. The fluid-storing container may further comprise a piston (e.g., 16) which is disposed inside the container at its bottom and moves up as the fluid inside is discharged.

For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

Figure 1:
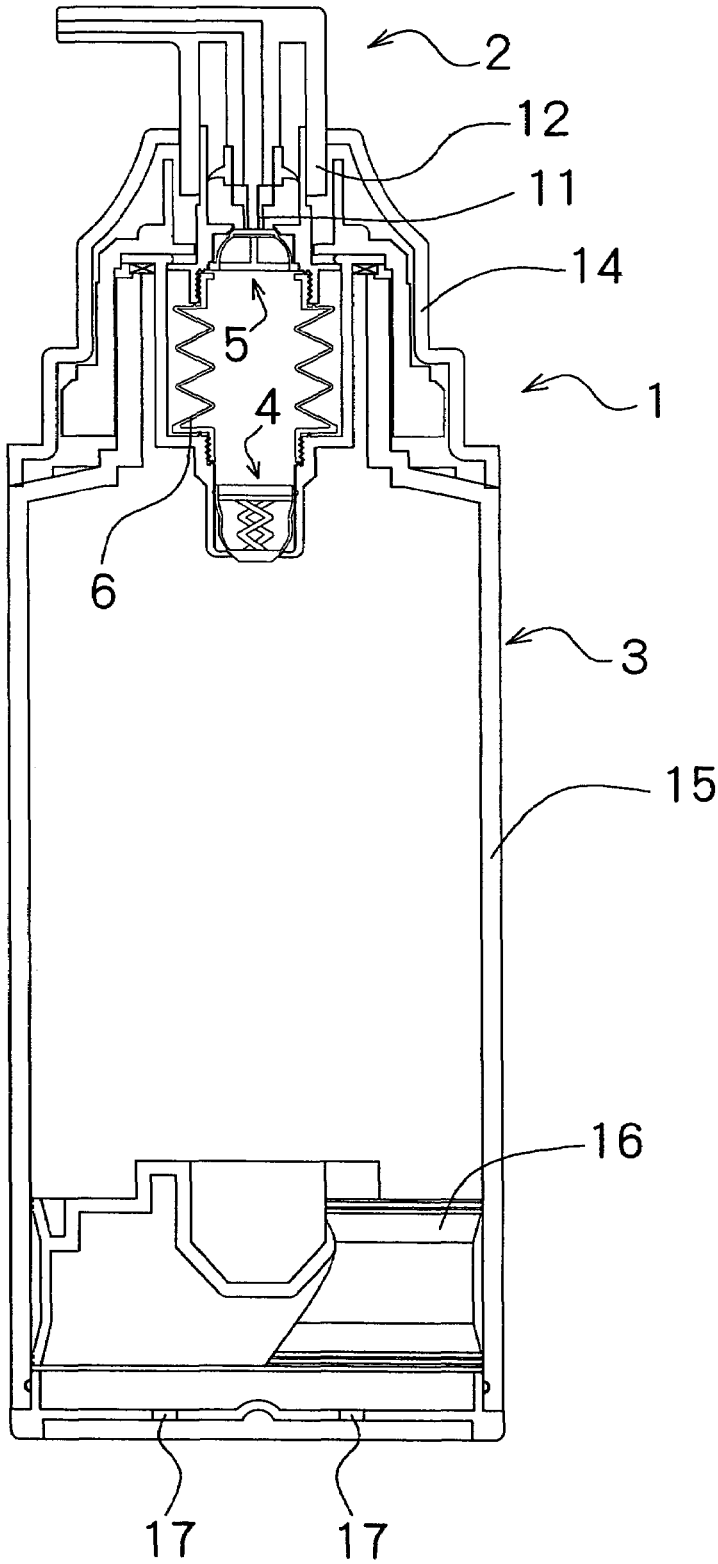
FIG. 1 is a longitudinal cross-sectional view showing a liquid container to which the liquid discharge pump 1 according to the Embodiment 1 of the present invention applies.

Explanation of symbols used is as follows: 1: Liquid discharge pump; 2: Nozzle head; 3: Liquid storing portion; 4: Inflow valve mechanism; 5: Outflow valve mechanism; 6: Bellows material; 11: First pressing portion; 12: Second pressing portion; 13: Liquid discharge portion; 15: Cylinder; 16: Piston; 19: Supporting portion; 20: Tubular portion; 26: Spring; 29: Liquid passage groove; 31: Valve material; 32: Valve seat material; 33: Opening portion; 34: Concave portion; 35: Supporting portion; 36: Valve portion; 37: Coupling portion; 38: Flexions; 39: Convex portion; 41: Valve material; 42: Valve seat material; 45: Supporting portion; 46: Valve portion; 47: Coupling portion; 51: First pressing portion; 52: Second pressing portion; 53: Valve seat material; 54: Valve seat material; 55: Second bellows material; 56: Opening portion; 57: Opening portion; 60: Valve body; 61: Supporting portion; 62: Valve portion; 63: Coupling portion.

DETAILED DESCRIPTION OF THE PREFERRED EMBODIMENT

Preferred embodiments of the present invention will be described with referent to the drawings. Although three examples are described below, the present invention should not be limited to the following embodiments, and any suitable combinations and modifications can be accomplished.

A first example of the present invention is a fluid discharge pump for discharging a fluid stored inside a fluid-storing portion from a nozzle head by pressing said nozzle head set up above said fluid-storing portion, which is characterized in that possessing a resinous bellows material having a bellows form, which can deform between a stretched position in which it holds a relatively large amount of fluid inside it and a folded-up position in which it holds a relatively small amount of fluid inside it; a resinous inflow valve mechanism which comprises a valve seat material in which an opening portion for letting the fluid flow in is formed, and a valve material having a ring-shaped supporting portion and a valve portion connected with said supporting portion via multiple coupling portions, and which is coupled with the lower end of said bellows material; a resinous outflow valve mechanism which comprises a valve seat material in which an opening portion for letting the fluid flow out is formed, and a valve material having a ring-shaped supporting portion and a valve portion connected with said supporting portion via multiple coupling portions, and which is coupled with the upper end of said bellows material; the first pressing portion which is coupled with said nozzle head and which moves the valve portion in said outflow valve mechanism in the direction in which the valve portion separates from the valve seat material when said nozzle head is pressed; the second pressing portion which is coupled with said nozzle head and which presses said bellows material from said stretched position to said folded-up position after said first pressing portion has moved the valve portion in said outflow valve mechanism in the direction in which the valve portion separates from the valve seat material.

A second example of the present invention is the fluid discharge pump as described in the first example, wherein said bellows material recovers to said stretched position from said folded-up position by its own elastic force, after a pressure applied to said nozzle head is removed.

A third example of the present invention is the fluid discharge pump as described in the first example, which possesses a spring which recovers said bellows material from said folded-up position to said stretched position, after a pressure applied to said nozzle head is removed.

Preferred embodiments of the present invention are described with referent to the drawings. FIG. 1 is a longitudinal section of a liquid container to which the fluid discharge pump 1 according to the Embodiment 1 of the present invention applies; FIG. 2 to FIG. 5 are enlarged views showing its relevant part.

Figure 2:
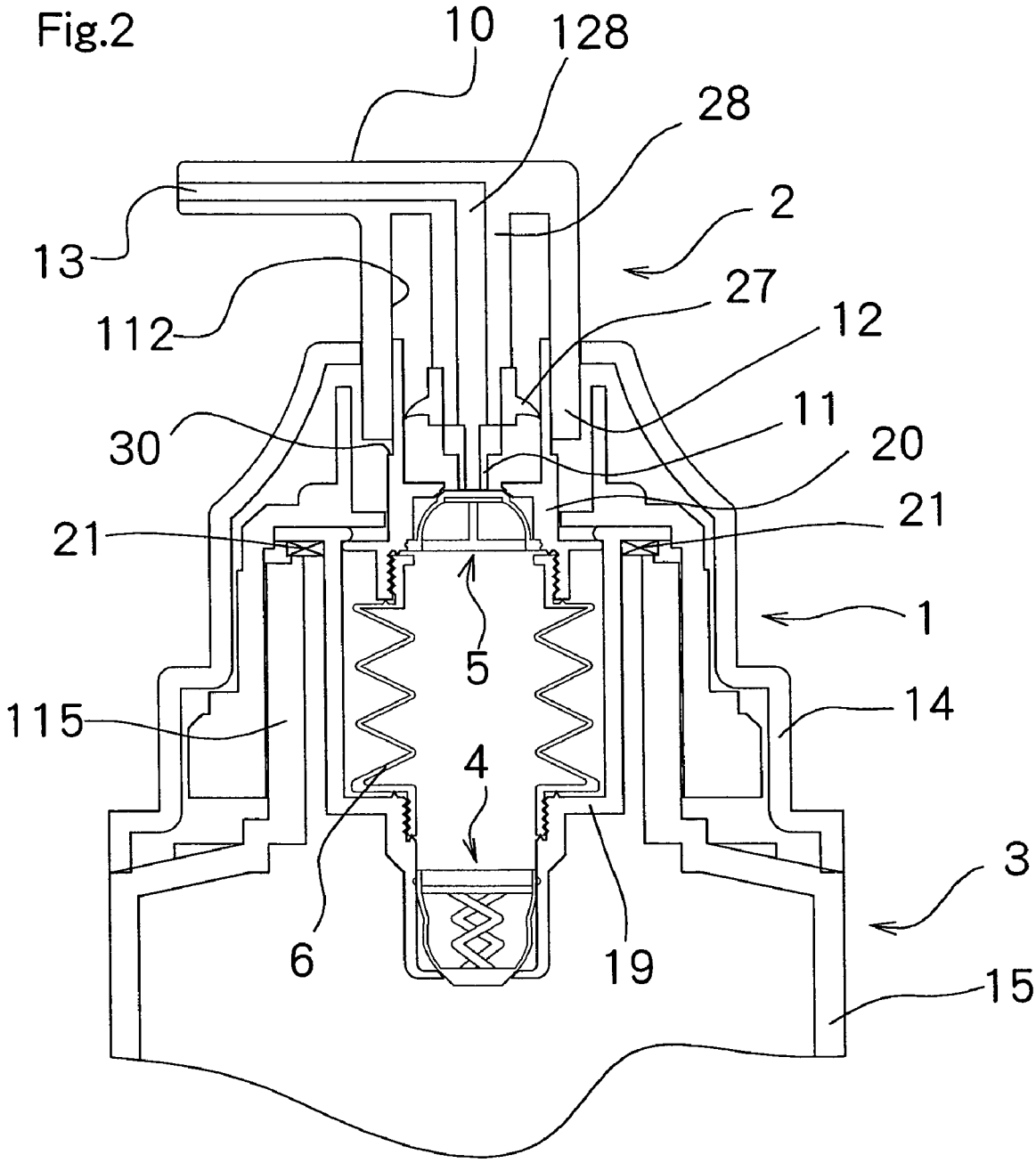
FIG. 2 is an enlarged cross-sectional view of the relevant part of the liquid container to which the liquid discharge pump 1 according to the Embodiment 1 of the present invention applies.
Figure 3:
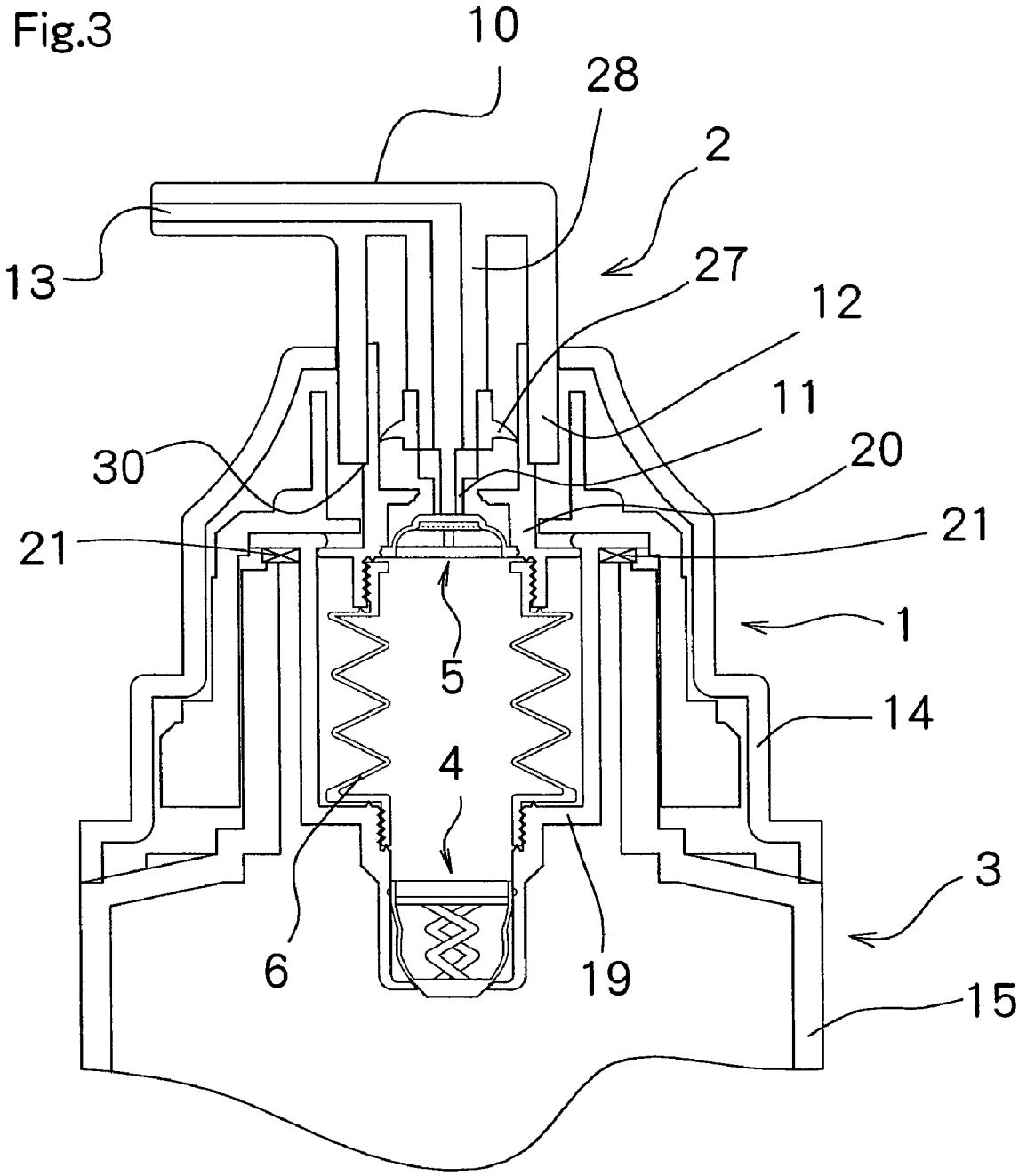
FIG. 3 is an enlarged cross-sectional view of the relevant part of the liquid container to which the liquid discharge pump 1 according to the Embodiment 1 of the present invention applies.
Figure 4:
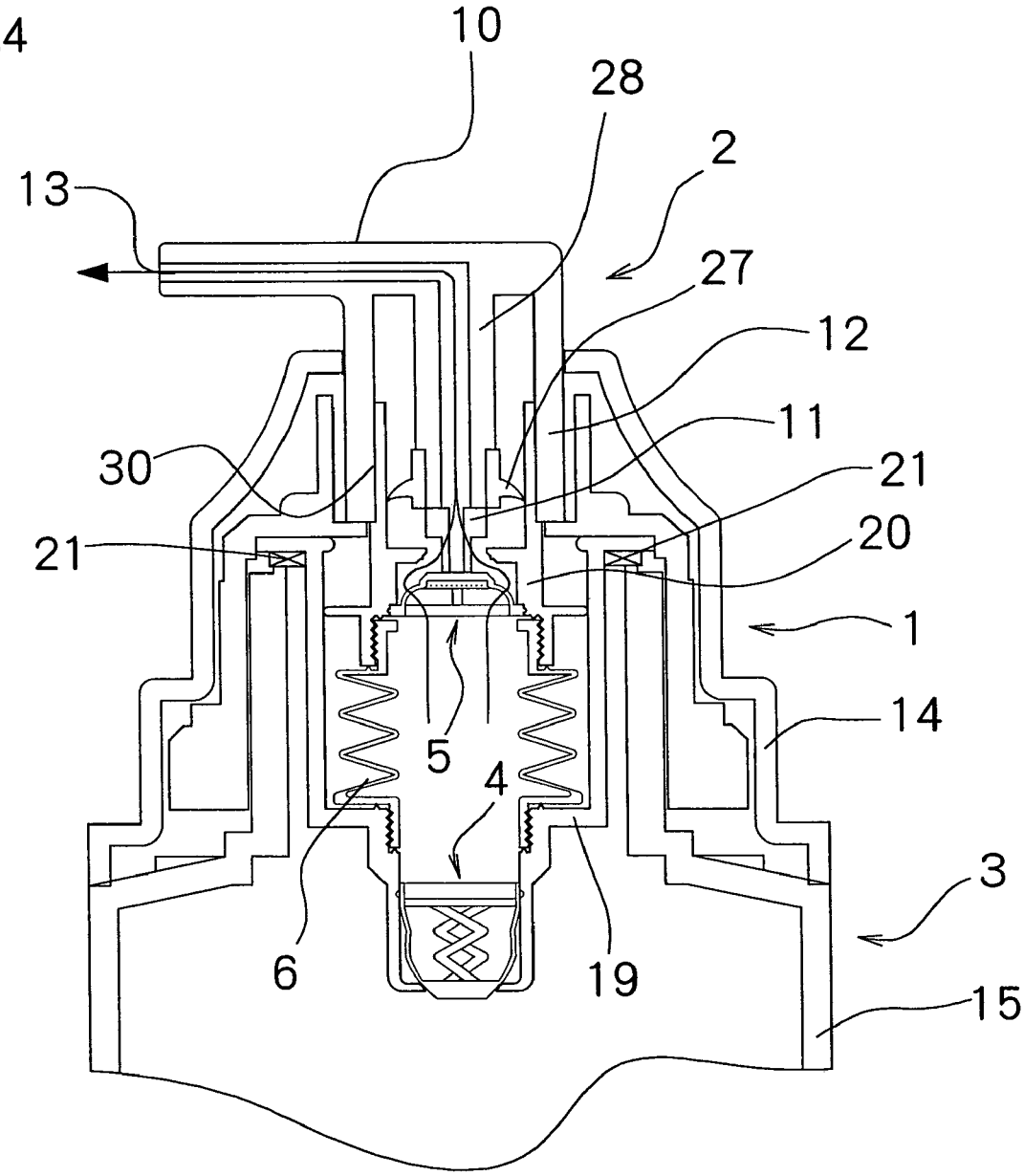
FIG. 4 is an enlarged cross-sectional view of the relevant part of the liquid container to which the liquid discharge pump 1 according to the Embodiment 1 of the present invention applies.
Figure 5:
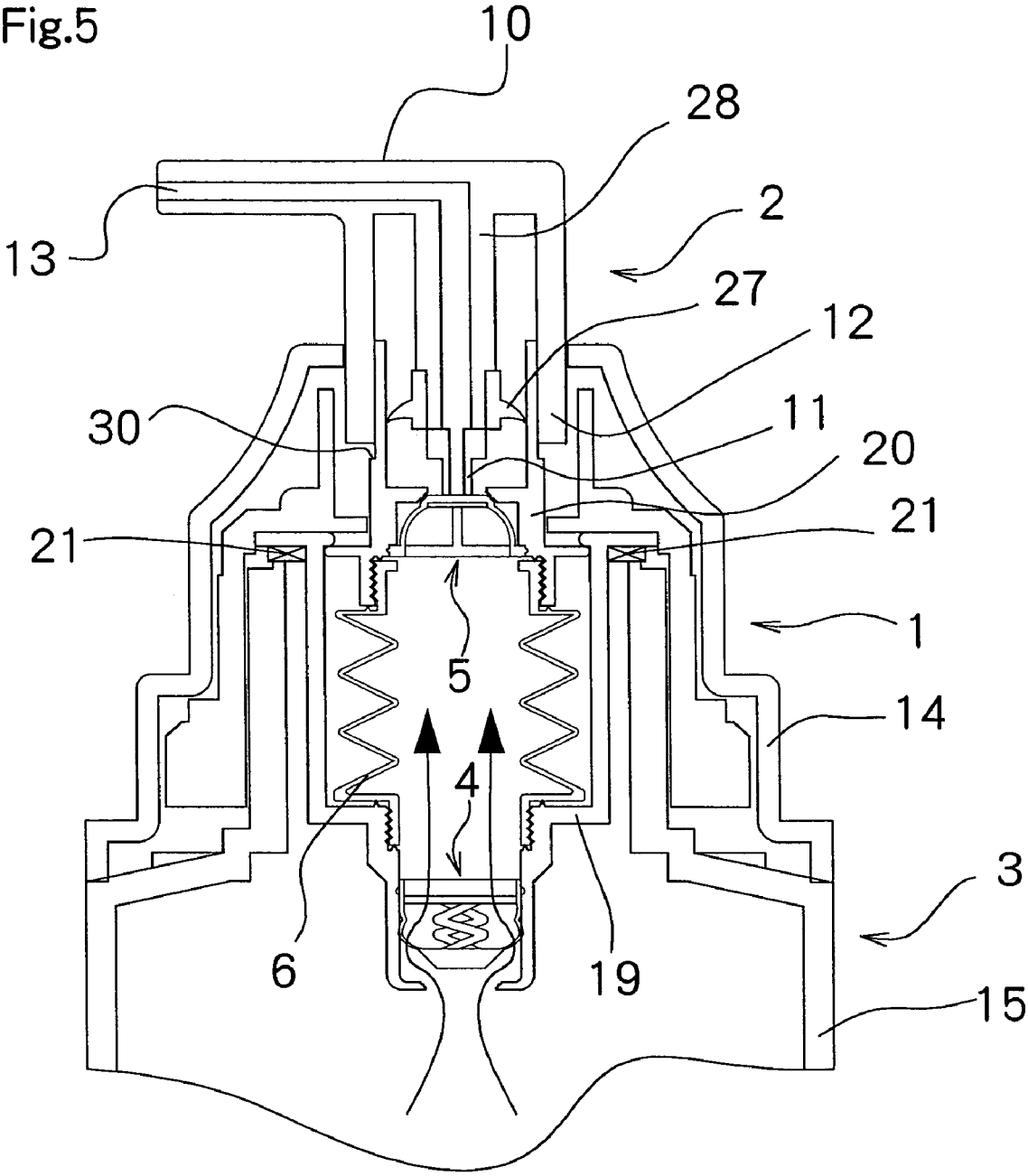
FIG. 5 is an enlarged cross-sectional view of the relevant part of the liquid container to which the liquid discharge pump 1 according to the Embodiment 1 of the present invention applies.

Of these diagrams, FIG. 1 and FIG. 2 respectively show positions in which the liquid discharge pump 1 is left with no stress applied; FIG. 3 shows a position in which the first pressing portion 11 in a nozzle head 2 presses a valve portion 46 in an outflow valve mechanism 5; FIG. 4 shows a position in which a bellows material 6 is in the process of going to a folded-up position from a stretched position by being pressed by the second pressing portion 12 in the nozzle head 2; FIG. 5 shows a position in which the bellows material 6 is in the process of going to the stretched position from the folded-up position with the nozzle head 2 being opened.

This liquid container is used as a container for beauty products for storing gels such as hair gels and cleansing gels, creams such as nourishing creams and cold creams or liquids such as skin lotions used in the cosmetic field. Additionally, this liquid container also can be used as a container for medicines, solvents or foods, etc.

In this specification, high-viscosity liquids, semifluids, gels that sol solidifies to a jelly, and creams and regular liquids are all referred to as liquids. Application of the present invention, however, is not limited to a pump used for the above-mentioned liquids; the present invention can apply to a fluid discharge pump used for the entire liquids including gases.

This liquid container comprises a liquid discharge pump 1 having an inflow valve mechanism 4, an outflow valve mechanism 5 and a bellows material 6, a nozzle head 2 having the first pressing portion 11, the second pressing portion 12 and a liquid discharge portion 13, and a liquid storing portion 3 which has an outer lid 14, a cylinder 15 and a piston 16 and stores a liquid inside it.

The nozzle head 2 here possesses the discharge portion 13 for discharging the liquid, the first pressing portion 11 for pressing a valve portion 45 in the outflow valve mechanism 5 and the second pressing portion 12 for pressing the bellows material 6 via a tubular material 20.

Additionally, the liquid storing portion 3 has the outer lid 14, the tubelike cylinder 15, the piston 16 which moves up and down inside the cylinder 16, and a bottom lid 18 in which multiple air holes are made. The cylinder 15 in this liquid storing portion 3 is connected liquidtightly with a supporting material 19 in the liquid discharge pump 1 via packing 21.

In this liquid container, by pumping up and down by pressing the head portion 10 in the nozzle head 2, the liquid stored inside the liquid storing portion 3 is discharged from the discharge portion 13. As an amount of the liquid inside the liquid storing portion decreases, the piston 16 moves toward the nozzle head 2 inside the cylinder 15.

Additionally, in this specification, upward and downward directions in FIGS. 1 to 5 are defined as upward and downward directions in the liquid container. In other words, in the liquid container according to this embodiment, the side of the nozzle head 2 shown in FIG. 1 is defined as the upward direction, and the side of the piston 16 is defined as the downward direction.

A configuration of the liquid discharge pump 1 is described below.

This liquid discharge pump 1 possesses the bellows material 6, the inflow valve mechanism 4 and the outflow valve mechanism 5.

The above-mentioned bellows material 6 is produced by molding a resin having prescribed elasticity into a bellows form. The bellows material 6 can deform between a stretched position as shown in FIG. 1 to FIG. 3, in which it holds a relatively large amount of fluid inside it and a folded-up position as shown in FIG. 4, in which it holds a relatively small amount of fluid inside it. The lower end of the bellows material 6 is engaged with a screw portion of the supporting material 19 which is set up in such a way that it surrounds the bellows material 6. The upper end of the bellows material 6 is engaged with a screw portion of the tubular material 20.

A configuration of the above-mentioned inflow valve mechanism 4 is described below. This inflow valve mechanism 4 is coupled with the lower end of the bellows material 6 via the supporting material 19. The inflow valve mechanism 4 allows the liquid to pass through from the liquid storing portion 3 into the bellows material 6 as well as it prohibits back-flowing of the liquid from the bellows material 6 into the liquid storing portion 3.

Figure 6A:
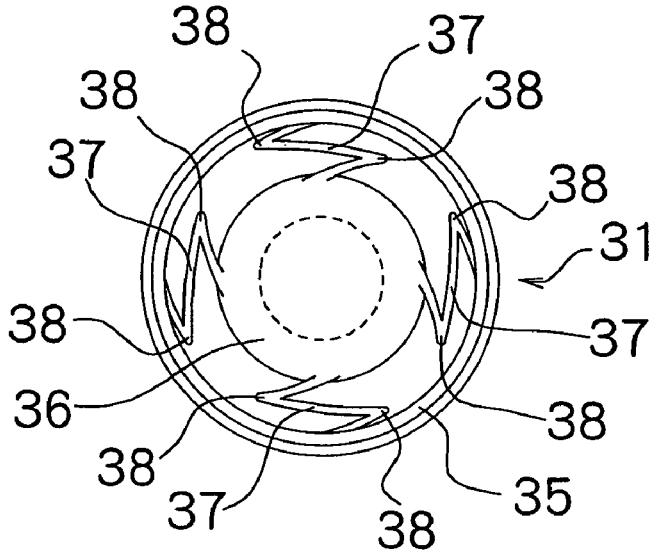
FIG. 6(A) and FIG. 6(B) are explanatory views (a plane view and a side view, respectively) showing a configuration of the inflow valve mechanism 4.
Figure 6B:
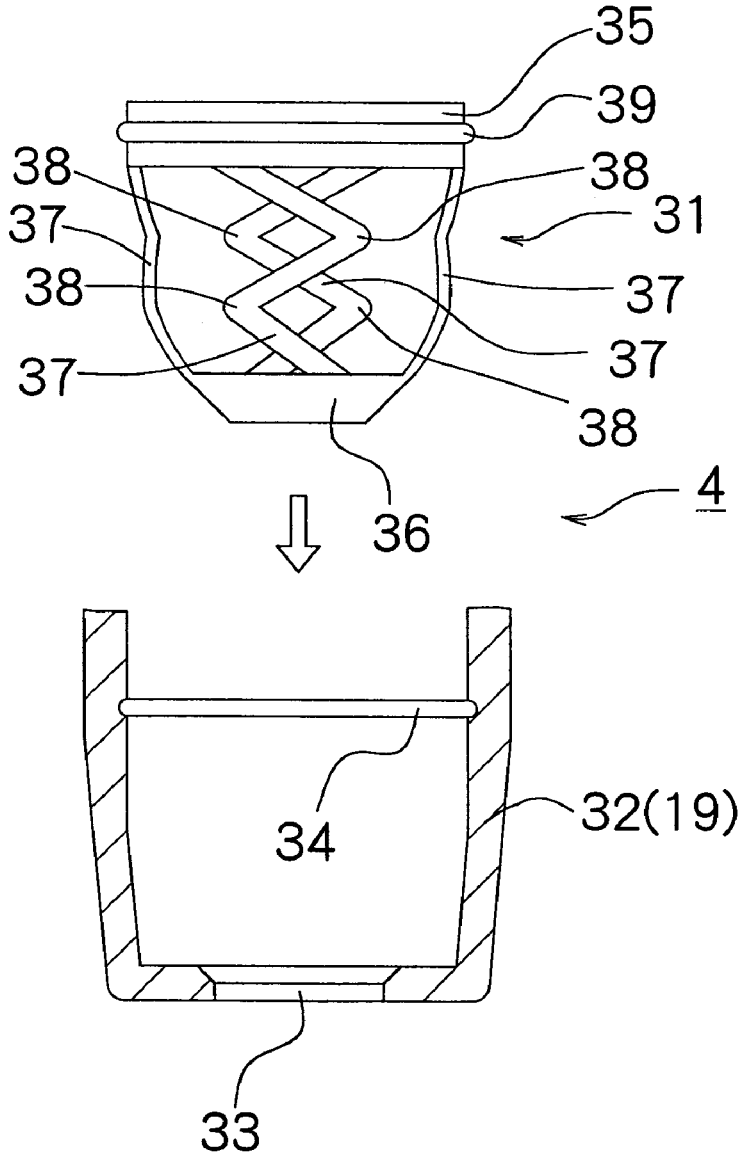
Figure 7A:
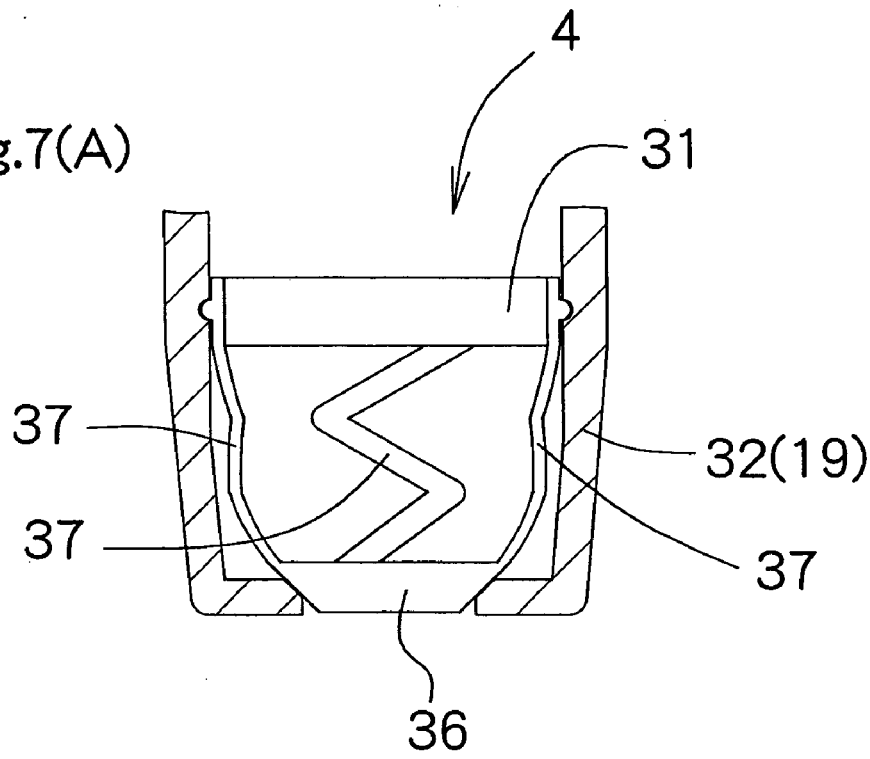
FIG. 7(A) and FIG. 7(B) are cross-sectional views showing motions of the inflow valve mechanism 4.
Figure 7B:
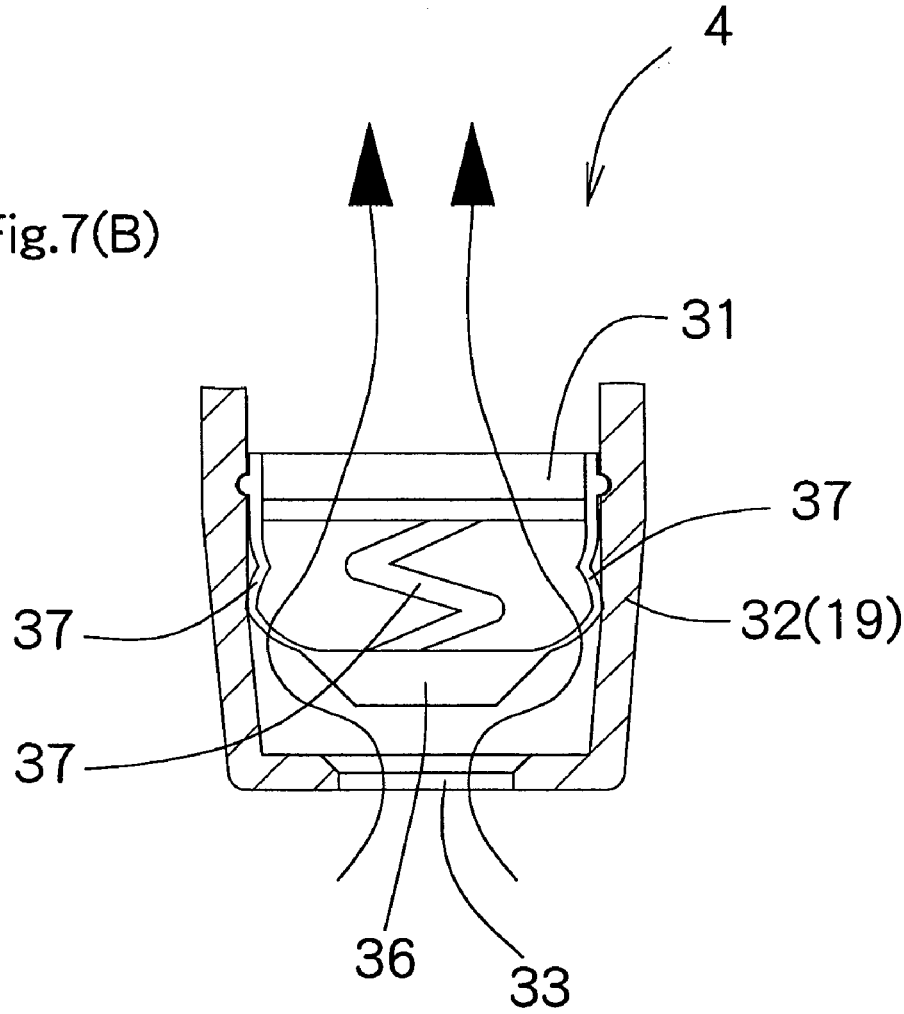

FIGS. 6(A) and 6(B) are explanatory views showing a configuration of the inflow valve mechanism 4; FIGS. 7(A) and 7(B) are sectional views showing its motions. FIG. 6(A) shows a plan view of the valve material 31; FIG. 6(B) shows a position in which the valve material 31 and the valve seat material 32 are assembled. Additionally, in FIG. 6(B), the valve material 31 is shown in a lateral view; the valve seat material 32 is shown in a section view.

As shown in these figures, the valve seat material 32 comprises the lower end portion of the above-mentioned supporting material 19 and has a nearly tubular shape at the bottom of which a circular opening portion 33 functioning as a valve seat is formed. Above the inner wall of this valve seat material 32, a concave portion 34 is formed.

The valve material 31 has a ring-shaped supporting portion 35 which is set up inside the valve seat material 32, a valve portion 36 having a shape corresponding to the circular opening portion 33 in the valve seat material 32 and four coupling portions 37 which couple the supporting portion 35 and the valve portion 36. The four coupling portions 37 have a pair of flexions 38 respectively. This valve material 31 is constructed in such a way that the valve portion 36 can move between a closed position in which the valve portion closes the opening portion 33 in the valve seat material 32 and an open position in which it opens the opening portion 33 by the flexibility of the four coupling portions 37.

On the outer circumferential surface of the supporting portion 35 in the valve material 31, a convex portion 39 is formed. Consequently, when the valve material 31 is inserted in the valve seat material 32, as shown in FIGS. 7(A) and 7(B), the concave portion 34 in the valve seat material 32 and the convex portion 39 in the valve material 31 engage with each other, fixing the valve material 31 inside the valve seat material 32. As a material used for the valve material 31 and the valve seat material 32, for example, a resin such as polyethylene and polypropylene, synthetic rubber such as silicon rubber or a mixture of these materials can be used.

In the inflow valve mechanism 4 having this configuration, when inside the bellows material 6 shown in FIG. 1 to FIG. 4 is depressurized, the valve portion 36 in the valve material 31 moves to a separated position in which the valve portion 36 is separated from the opening portion 33 in the valve seat material 32, as shown in FIG. 7(B). By this, the fluid passes through the opening portion 33. When inside the bellows portion 6 is not depressurized, the valve portion 36 in the valve material 31 moves to a closed portion in which the valve portion 36 closes the opening portion 33 in the valve seat material 32 as shown in FIG. 7(A).

In this inflow valve mechanism 4, the supporting portion 35 and the valve portion 36 in the valve material 31 are coupled by four coupling portion 37. Consequently, it becomes possible to prevent occurrence of an inappropriate tilt in the valve portion 36. Additionally, to prevent occurrence of an inappropriate tilt in the valve portion 36 effectively, it is preferred to provide three or more coupling portions 37; it is preferred to provide the coupling portions at even intervals.

Additionally, in this inflow valve mechanism 4, when the valve portion 36 moves from the closed position to the open position, the coupling portions 37 move in the direction in which the coupling portions contact the inner walls of the valve seat material 32. By this motion, when an inappropriate tilt occurs in the valve portion 36, the coupling portions 37 contact the inner walls of the valve seat material 32. Consequently, the valve portion 36 does not tilt further.

Furthermore, in this inflow valve mechanism 4, four coupling portions 37 coupling the supporting portion 35 and the valve portion 36 have a pair of flexions respectively. Consequently, respective coupling portions 37 have adequate elasticity, enabling the valve portion 36 to reciprocate smoothly between the closed portion and the open position. Additionally, it is preferred that a thickness of these coupling portions 37 is 1 mm or less; a thickness within the ranger of 0.3 mm to 0.5 mm is more preferably.

A configuration of the above-mentioned outflow valve mechanism 5 is described below. This outflow valve mechanism 5 is coupled with the upper end of the bellows material 6 via the tubular material 20. This outflow valve mechanism 5 allows the liquid to pass through from the bellows material 6 to the discharge portion 13 of the nozzle head 2 as well as it prohibits back-flowing of the liquid from the discharge portion 13 to the bellows material 6.

Figure 8:
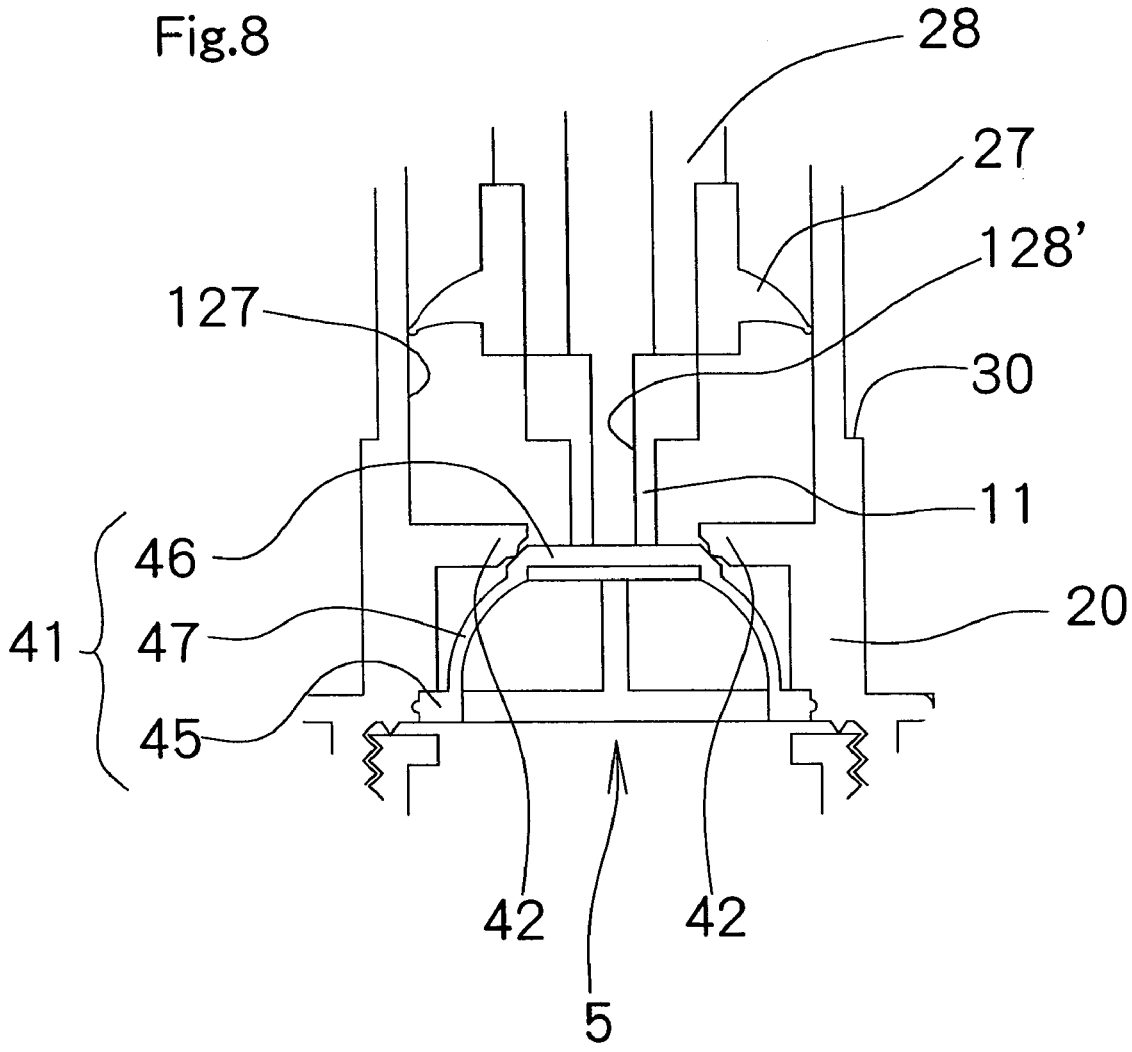
FIG. 8 is an explanatory view showing motions of the outflow valve mechanism 5.
Figure 9:
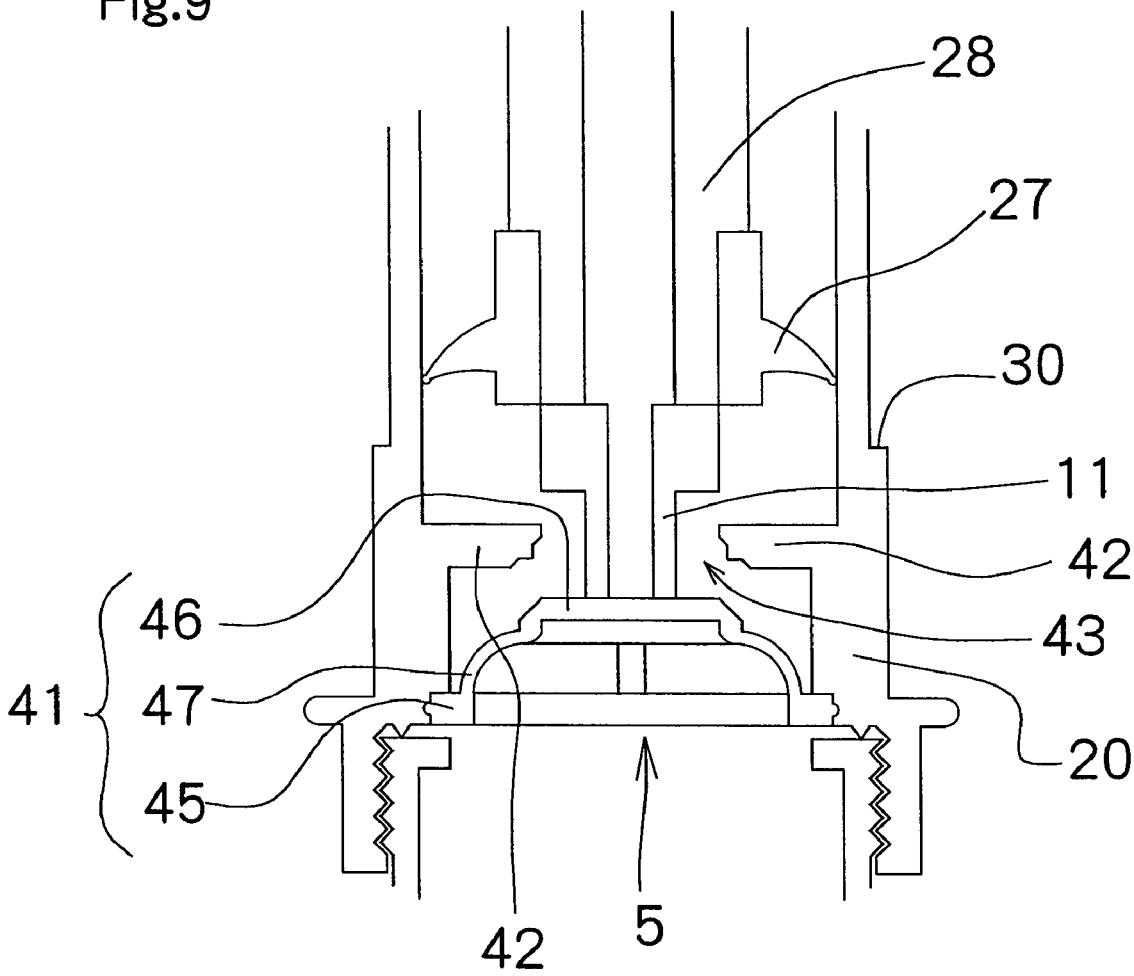
FIG. 9 is an explanatory view showing motions of the outflow valve mechanism 5.
Figure 10A:
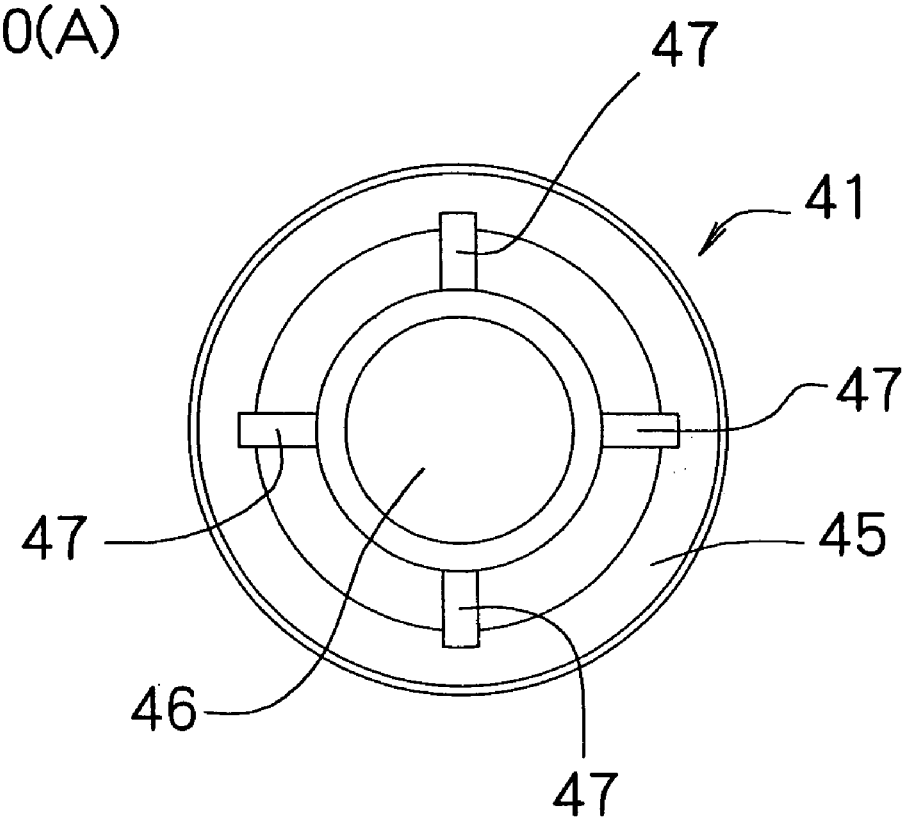
FIG. 10(A) and FIG. 10(B) are schematic view (a plane view and a side view, respectively) of the valve material 41.
Figure 10B:
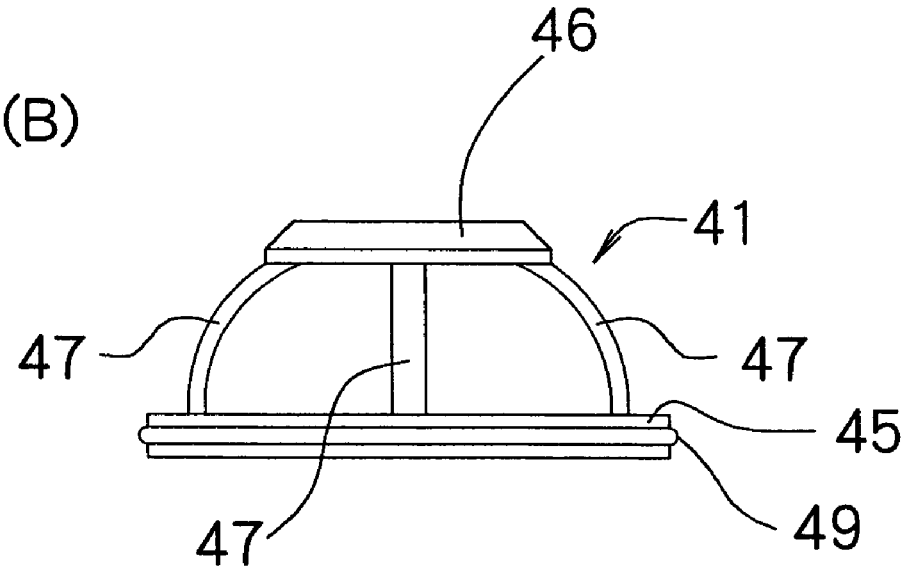

FIG. 8 and FIG. 9 are explanatory views showing the motions of this outflow valve mechanism 5; FIGS. 10(A) and 10(B) are schematic views of the valve material 41.

This outflow valve mechanism 5 comprises a valve seat material 42 having a circular opening portion at its center, which is formed on the inner circumferential surface of the tubular material 20, and a valve material 41.

As its plan view shown in FIG. 10(A) and its lateral view shown in FIG. 10(B), the valve material 41 has a ring-shaped supporting portion 45 set up inside the tubular material 20, a valve portion 46 having a shape corresponding to the circular opening portion in the valve seat material 42, and four coupling portion 47 which couple the supporting portion 45 and the valve portion 46. This valve material 41 is constructed in such a way that the valve portion 46 can move between a closed position in which the valve portion closes the opening portion in the valve seat material 42 and an open position in which the valve portion opens the opening portion.

On the outer circumferential surface of the supporting portion 45 in the valve material 41, a convex portion 49 is formed. Consequently, when the valve material 41 is inserted in the tubular material 20, as shown in FIG. 8 and FIG. 9, the concave portion 49 in the tubular material 20 and the convex portion 49 in the valve material 41 engage with each other, fixing the valve material 41 inside the tubular material 20. As a material used for the valve material 41 and the tubular material 20, for example, a resin such as polyethylene and polypropylene, synthetic rubber such as silicon rubber or a mixture of these materials can be used.

In the outflow valve mechanism having this configuration, when the valve material 41 is not pressed by the first pressing portion 11 as shown in FIG. 8, the valve portion 46 in the valve material 41 is positioned in a closed position in which the valve portion closes an opening portion in the valve seat material 42 by the elasticity recovering force of four coupling portions 47. When the valve portion 46 in the valve material 41 is pressed by the first pressing portion 11 as shown in FIG. 9, the valve portion 46 in the valve material 41 moves to a separated position in which the valve portion is separated from the opening portion in the valve seat material 42, letting the fluid pass through the opening portion.

In this outflow valve mechanism 5 as well, the supporting portion 45 in the valve material 41 and the valve portion 46 are coupled by four coupling portions 47. Consequently, it becomes possible to prevent occurrence of an inappropriate tilt in the valve portion 46. Additionally, to prevent occurrence of an inappropriate tilt in the valve portion 46 effectively, it is preferred to provide three or more coupling portions 47; it is preferred to provide the coupling portions at even intervals.

As a material for the valve material 41 in this outflow valve mechanism 5, it is necessary to use a material having rigidity higher than that of the valve material 31 in the inflow valve mechanism 4 (which is difficult to move to the separated position) to prevent the reverse flow of the air, etc.

Figure 11:
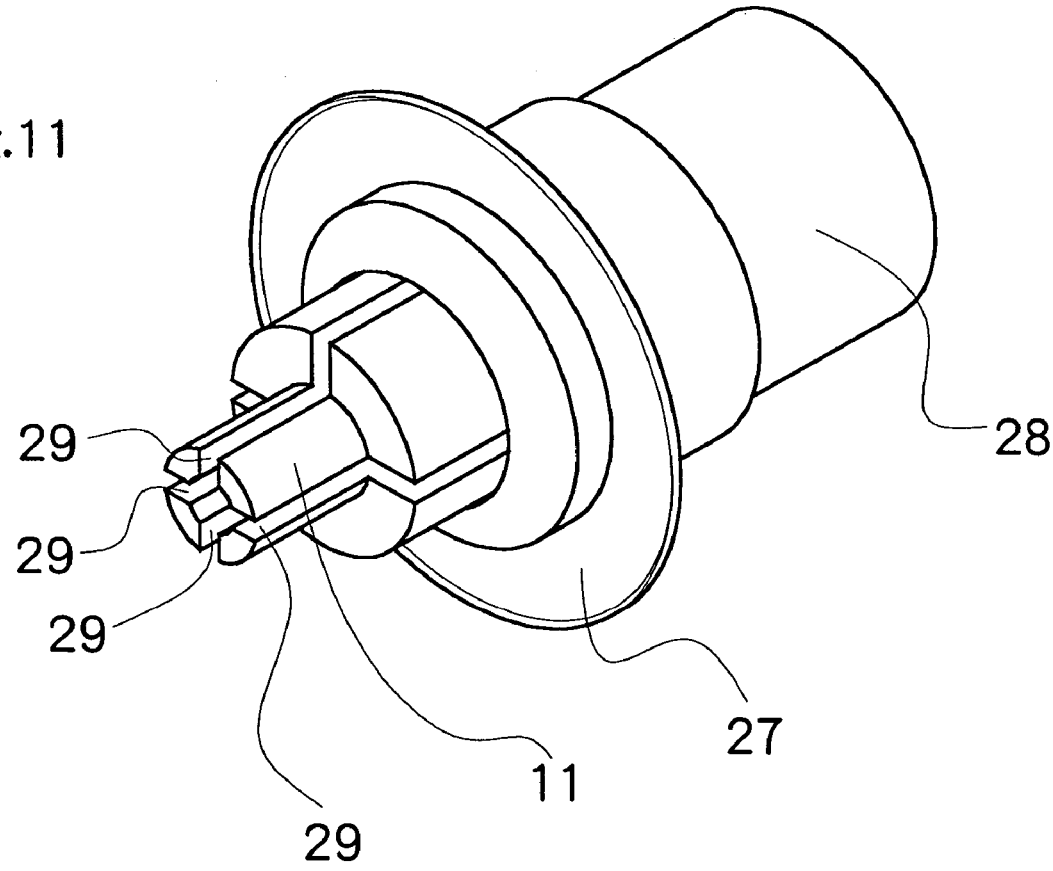
FIG. 11 is an enlarged oblique perspective view of the vicinity of the first pressing portion 11.

FIG. 11 is an enlarged oblique perspective view of the vicinity of the above-mentioned first pressing portion 11.

This first pressing portion 11 is set up at the lower end of a coupling tube 28 which is coupled with the discharge portion 13 in the nozzle head 2. In this first pressing portion 11, four liquid passage grooves 29 which are communicated with inside the coupling tube 28 are formed. Additionally, on the outer circumferential portion of the coupling tube 28, packing 27 is provided.

Liquid discharge motions by the liquid discharge container possessing the above-mentioned liquid discharge pump 1 are described below.

In an initial position, as shown in FIG. 1 and FIG. 2, the bellows material 6 is in the stretched position by the elastic force of the bellows material 6. In this position, a relatively large amount of liquid is stored inside the bellows material 6.

When the head portion 10 in the nozzle head 2 is pressed in this position, the valve portion 46 of the valve material 41 is first pressed by the first pressing portion 11 as shown in FIG. 3; the valve portion 46 moves to a separated position in which the valve portion is separated from the opening portion in the valve seat material 42. By this, a flow path leading to the discharge portion 13 in the nozzle head 2 from inside the bellows material 6 is formed.

When the head portion 10 in the nozzle head 2 is pressed further in this position, the second pressing portion 12 in the nozzle head 2 contacts a convex portion 30 formed on the outer circumference of the tubular material 20, and the tubular material 20 descends along with the second pressing portion 12. By this, as shown in FIG. 4, the bellows material 6 begins deforming from the stretched position to the folded-up position. By this motion, the liquid inside the bellows material 6 is pressurized, flows out to the discharged portion 13 via the opening portion of the valve seat material 42 and the liquid passage grooves 29 of the first pressing portion 11 and the coupling tube 28, and is discharged from the discharged portion 13.

After the bellows material 6 has taken the folded-up position and when the pressure applied to the nozzle head 2 is removed, the first pressing portion 11 is pressed by the resilience of the valve material 41 of the outflow valve mechanism 5 and the nozzle head 2 ascends. Consequently, the valve portion 46 in the valve material 41 contacts the opening portion in the valve seat material 42 as shown in FIG. 5 and FIG. 8, and a flow path leading to the discharge portion 13 in the nozzle head 2 from inside the bellows material 6 is closed.

Additionally, by the resilience of the bellows material 6, the nozzle head 2 further ascends along with the tubular material 20. In this position, because inside the bellows material 6 is depressurized, the valve portion 36 in the valve material 31 moves to a separated position in which the valve portion is separated from the opening portion 33 in the valve seat material 32 as shown in FIG. 7(B). As shown in FIG. 5 by the arrow, the liquid, therefore, flows into the bellows material 6 from the liquid storing portion 3. When the bellows material 6 recovers to its stretched position, it returns to the initial position shown in FIG. 2.

By repeating the motions described in the above, discharging the liquid stored in the liquid storing portion 4 from the nozzle head 2 becomes possible.

Additionally, in the above-mentioned embodiment, respectively different valve materials 31 and 41 are used for the inflow valve mechanism 4 and the outflow valve mechanism 5. It is possible, however, to adopt valve materials common to the inflow valve mechanism 4 and the outflow valve mechanism 5 as well.

In the above-mentioned embodiment, the bellows material 6 recovers to its stretched position from its folded-up position using the elastic force of the bellows material 6 itself. Other means for giving momentum can be used as well.

Figure 12:
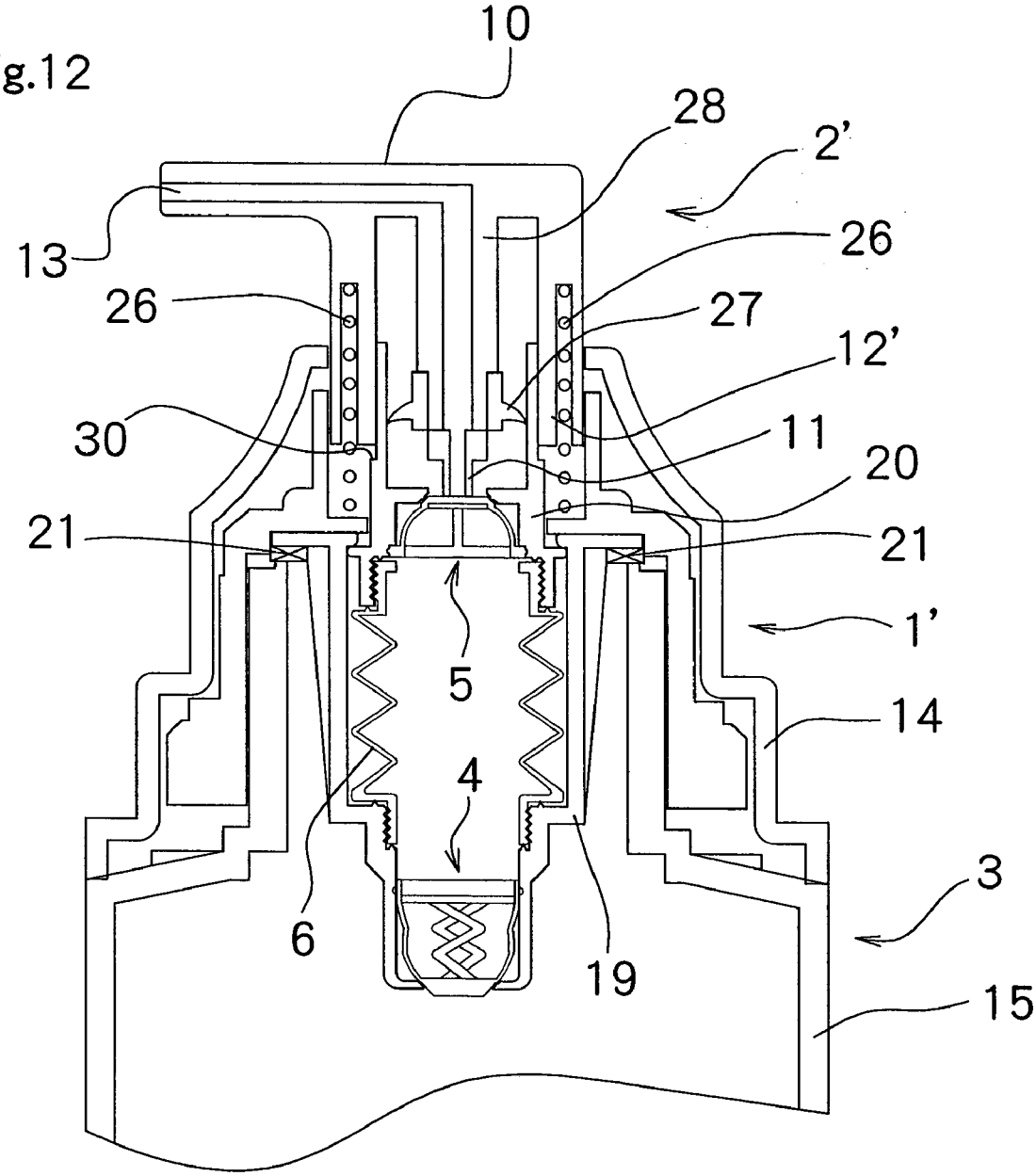
FIG. 12 is an enlarged cross-sectional view showing the relevant part of a liquid container to which a liquid discharge pump 1 according to a modified version applies.

FIG. 12 is an enlarged view showing the relevant part of a liquid container to which a liquid discharge pump 1 according to a modified version applies.

In this liquid discharge pump 1', in a position leading to the outer circumferential portion of a tubular material 20 from a groove portion formed in a nozzle head 2', a spring 26 for recovering a bellows material 6 from a folded-up position to a stretched position by giving momentum to the nozzle head 2' upward after a pressure applied to the nozzle head 2' is removed is provided. By adopting this configuration, it becomes possible to recover the bellows material 6 to the stretched position quickly even when the viscosity of the liquid is high, etc.

Figure 13:
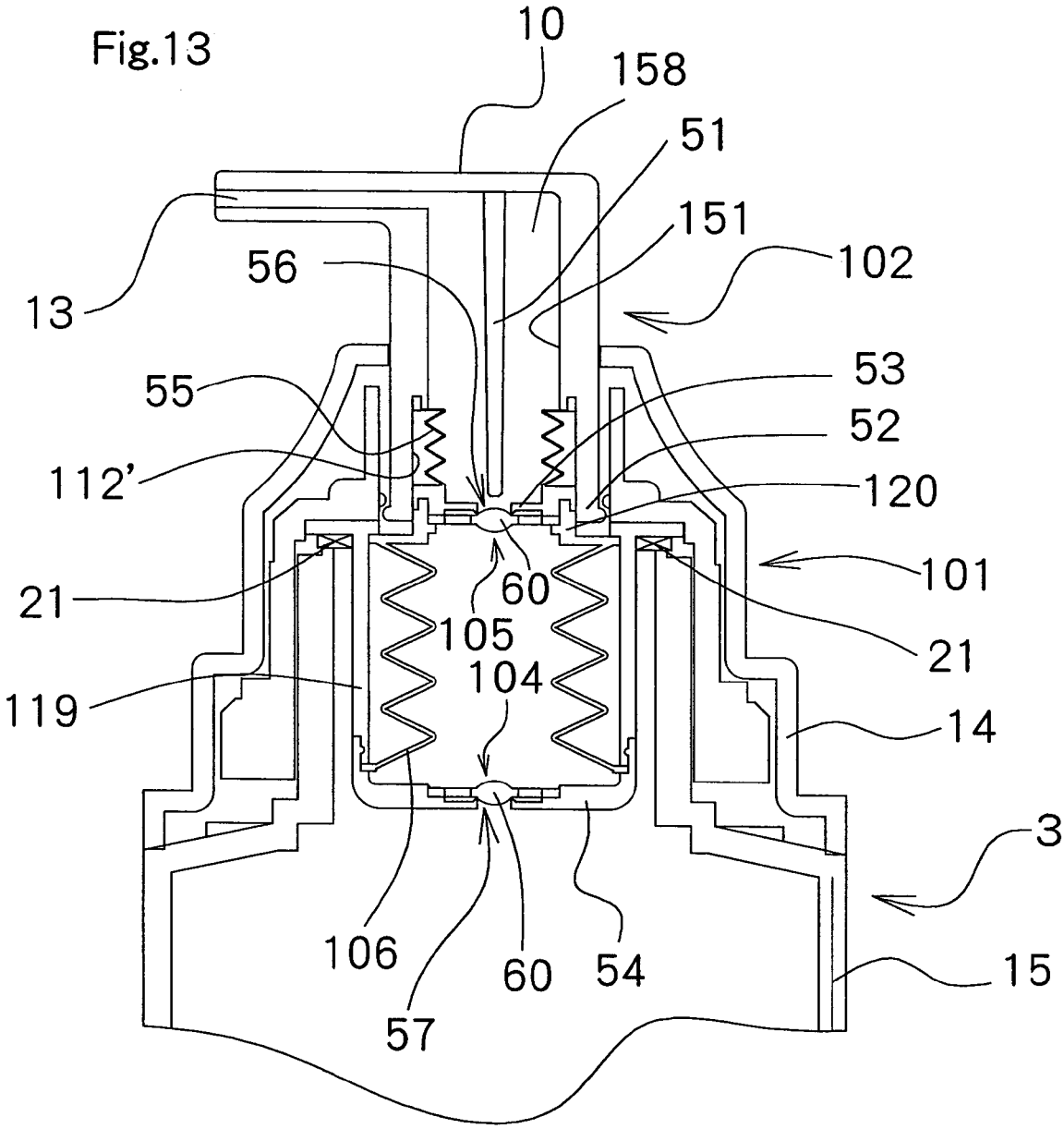
FIG. 13 is an enlarged cross-sectional view of the relevant part of a liquid container to which a liquid discharge pump according to the Embodiment 2 of the present invention applies.

An alternative embodiment of the present invention is described below. FIG. 13 is an enlarged view of the relevant part of a liquid container to which a liquid discharge pump according to the Embodiment 2 of the present invention applies. Additionally, when the same materials as used in Embodiment 1 are used in this embodiment, the same symbols are used and detailed descriptions of the materials are omitted. Symbols not used in Embodiment 1 are established earlier.

A configuration of an inflow valve mechanism 4 according to the Embodiment 2 is described below. This inflow valve mechanism 104 is coupled with the lower end of a bellows material 106. This inflow valve mechanism 104, similarly to the Embodiment 1, allows a liquid to pass through from a liquid storing portion 3 into the bellows material 106 as well as it prohibits back-flowing of the liquid from the bellows material 106 to the liquid storing portion 3. This inflow valve mechanism 104 comprises a resinous valve seat material 105 possessing an opening portion 57 for letting the liquid flow in and a valve material 60.

Figure 15:
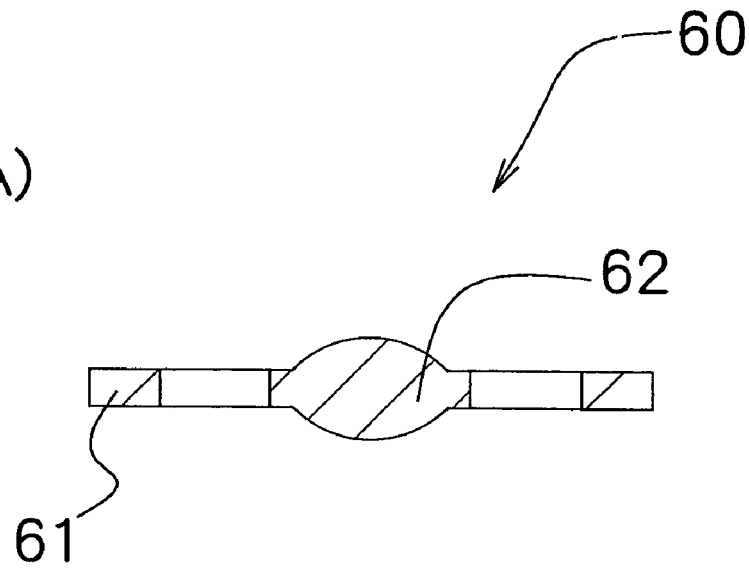
FIG. 15(A) and FIG. 15(B) are explanatory views (a side cross-sectional view and a plane view, respectively) showing a configuration of the valve material 60.
Figure 15:
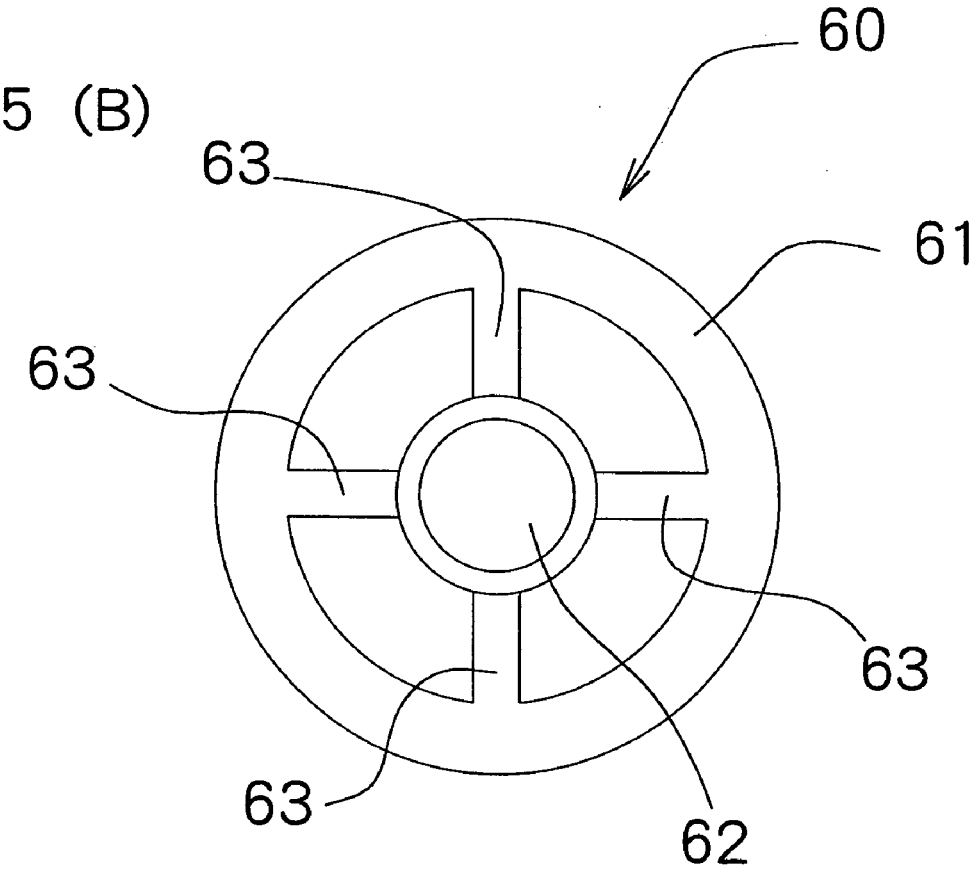

FIGS. 15(A) and 15(B) show explanatory views showing a configuration of the valve material 60. FIG. 15(A) shows a longitudinal section of the valve body; FIG. 15(B) shows a plan view of the valve body.

As shown in these figures, the valve material 60 possesses a ring-shaped supporting portion 61, a valve portion 62 set up at nearly the center of the supporting portion 61 and four coupling portions 63 which couple the supporting portion 61 and the valve portion 62. An outside diameter of the valve portion 62 in the valve material 60 is smaller than an inside diameter of the supporting portion 61 and larger than an inside diameter of an opening portion 57 formed in the valve seat material 54 shown in FIG. 13 to FIG. 16. Additionally, this valve portion 62 itself has a convex shape facing toward the opening portion 57 in the valve seat material 54. Consequently, this valve portion 62 is able to close the opening portion 57 by contacting the opening portion 57.

As shown in FIG. 15(A), the valve portion 62 in the valve material 60 has a convex shape in both directions: In the direction of the opening portion 57 in the valve seat material 54; in the direction opposite to the opening portion 57 in the valve seat material 54. In other words, the valve portion 62 has a plane-symmetrical shape, which facilitates assembling work when a valve mechanism using this valve material 60 is assembled.

The valve material 60 comprises a resin having elasticity. As a resin having elasticity, a resin such as polyethylene and polypropylene, synthetic rubber such as silicon rubber or a mixture of these materials can be used.

In the inflow valve mechanism having this configuration, when inside the bellows material 106 shown in FIG. 13 to FIG. 16 is depressurized, the valve portion 62 in the valve material 60 moves to a separated position in which the valve portion is separated from the opening portion 57 in the valve seat material 54. By this, a liquid passes through the opening portion 57. When inside the bellows material 106 is not depressurized, the valve portion 62 in the valve material 60 moves to a closed position in which the valve portion closes the opening portion 57 by the elasticity recovering force of the four coupling portions 63.

A configuration of the above-mentioned outflow valve mechanism 105 is described below. This outflow valve mechanism 105 is coupled with the upper end of the bellows material 106. This outflow valve mechanism 105, similarly to the Embodiment 1, allows the liquid to pass through from the bellows material 6 to a discharge portion 13 of the nozzle head 102 as well as it prohibits back-flowing of the liquid from the discharge portion 13 to the bellows material 106. This outflow valve mechanism 105 comprises a resinous valve seat material 53 possessing an opening portion 56 for letting the liquid flow out and a valve material 60 similar to that of the inflow valve mechanism 104 shown in FIG. 15.

In this regard, as the valve material 60 in this outflow valve mechanism 105, it is necessary to use a material having rigidity higher than that of the valve material 60 in the inflow valve mechanism 104 (which is difficult to move to the separated position) to prevent the reverse flow of the air, etc.

Additionally, in this embodiment, the nozzle head 102 is hollow. In this hollow portion, the first pressing portion 51 which corresponds to the first pressing portion 111 in the Embodiment 1 is provided. Between the nozzle head 2 and the valve seat material 53, the second bellows material 55 is provided.

In the outflow valve mechanism 105 having this configuration, when the valve material 60 is not pressed by the first pressing portion 51 as shown in FIG. 13, the valve portion 62 in the valve material 60 is put in a closed position in which the valve portion closes the opening portion 56. When the valve portion 62 in the valve material 60 is pressed by the first pressing portion 51 as shown in FIG. 14, the valve portion 62 in the valve material 60 moves to a separated position in which the valve portion is separated from the opening portion 56 and the liquid passes through the opening portion 56.

Liquid discharge motions by a liquid discharge container possessing the liquid discharge pump 1 according to the Embodiment 2 are described below.

In an initial position as shown in FIG. 13, the bellows material 106 is in the stretched position by the elastic force of the bellows material 106. In this position, a relatively large amount of liquid is stored inside the bellows material 106.

Figure 14:
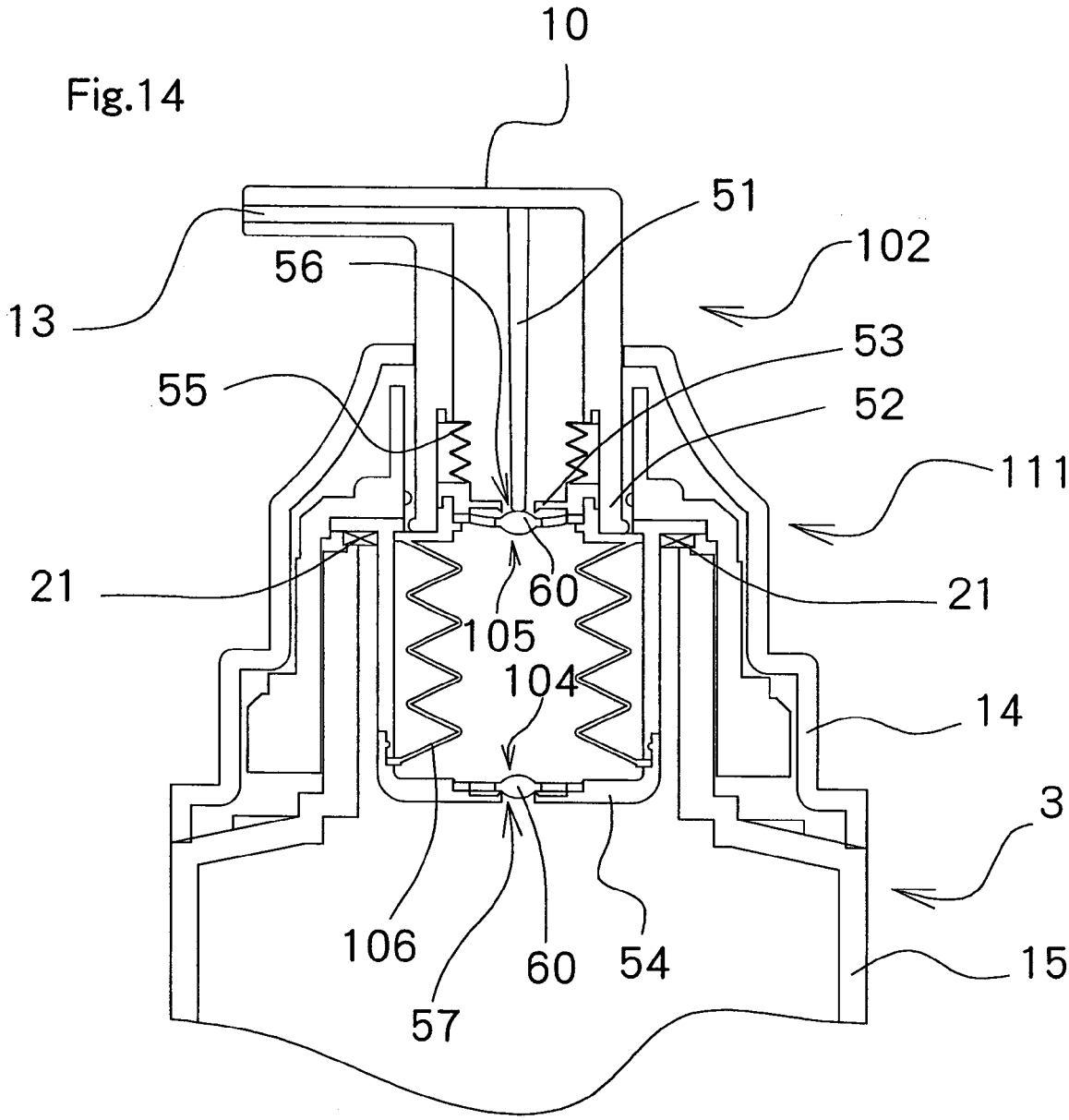
FIG. 14 is an enlarged cross-sectional view of the relevant part of the liquid container to which a liquid discharge pump according to the Embodiment 2 of the present invention applies.

When the head portion 10 in the nozzle head 102 is pressed in this position, the valve portion 62 of the valve material 60 is first pressed by the first pressing portion 51 as shown in FIG. 14; the valve portion 62 moves to the separated position in which the valve portion is separated from the opening portion in the valve seat material 53. By this, a flow path leading to the discharge portion 13 in the nozzle head 102 from inside the bellows material 106 is formed.

When the head portion 10 in the nozzle head 102 is pressed further in this position, the second pressing portion 52 in the nozzle head 102 contacts the upper end of the bellows material 106, and the upper end of the bellows material 106 descends along with the second pressing portion 52. By this, as shown in FIGS. 15(A) and 15(B), the bellows material 106 begins deforming from the stretched position to the folded-up position. By this motion, the liquid inside the bellows material 106 is pressurized, flows out to the discharged portion 13 via the opening portion 56 of the valve seat material 53, and is discharged from the discharged portion 13.

After the bellows material 106 has taken the folded-up position and when a pressure applied to the nozzle head 102 is removed, being pressed by the resilience of the second bellows material 55, the nozzle head 102 ascends. Consequently, the valve portion 62 in the valve material 60 contacts the opening portion 56 in the valve seat material 53, and a flow path leading to the discharge portion 13 in the nozzle head 102 from inside the bellows material 6 is closed.

Additionally, by the resilience of the bellows material 106, the nozzle head 102 ascends further. In this position, because inside the bellows material 106 is depressurized, the valve portion 62 in the valve material 60 moves to a separated position in which the valve portion is separated from the opening portion 57 in the valve seat material 54. Therefore, the liquid flows into the bellows material 106 form the liquid storing portion 3. When the bellows material 106 recovers to its stretched position, it returns to the initial position shown in FIG. 13.

By repeating the motions described in the above, discharging the liquid stored in the liquid storing portion 3 from the nozzle head 102 becomes possible.

Additionally, in the above-mentioned embodiment, the bellows material 106 is recovered from its folded-up position to its stretched position using the elastic force of the bellows material 106 itself. In this embodiment as well, momentum given by a spring, etc. can be used as is the case with the embodiment shown in FIG. 12.

According to the invention described in the first example, because the resinous bellows material having a bellows form, which can deform between the stretched position in which it holds a relatively large amount of fluid inside it and the folded-up position in which it holds a relatively small amount of fluid inside it is used, manufacturing costs of a liquid discharge pump can be held down as compared with a liquid discharge pump using a piston, etc. and it becomes possible to prevent liquid leakage reliably.

Additionally, because the inflow valve mechanism and the outflow valve mechanism each of which comprises the valve seat material, and the valve material having the ring-shaped supporting portion and the valve portion connected with the supporting portion via multiple coupling portions are used, it becomes possible to discharge a liquid accurately by executing inflow motions and outflow motions reliably while the configuration is simple and inexpensive.

According to the invention described in the second example, because the bellows material is recovered to its stretched position from its folded-up position by its own elastic force after a pressure applied to the nozzle head is removed, it becomes possible to make a configuration of the equipment simple.

According to the invention described in the third example, because a spring which recovers the bellows material from its folded-up position to its stretched position by giving momentum to the nozzle head upward after a pressure applied to the nozzle head is removed, it becomes possible to recover the bellows material to the stretched position quickly even when the viscosity of the liquid is high, etc.

In the present invention, any suitable combinations of the elements described above can be accomplished as long as one or more effects or advantages described above is achieved. Further, in the present invention, any suitable plastic material can be used including rubbers such as silicon rubbers or soft resins such as soft polyethylene. For support portions (such as the valve seat portion) to which other portions (such as the valve portion) are fitted by press-fitting, hard resins such as hard polyethylene can preferably be used. The structures can be formed by any suitable methods including injection molding. The resin material can be selected based on the type of fluid stored in the container. If a high viscose fluid such as a gel is stored in the container, a hard resin may be used for the valve mechanism. If a low viscose fluid such as a thin liquid or a formed liquid is stored in the container, a more resilient resin may be used for the valve mechanism.

This application claims priority to Japanese patent application No. 2002-214621, filed Jul. 24, 2002, the disclosure of which is herein incorporated by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A fluid discharge pump for discharging a fluid stored inside a fluid-storing portion, comprising:

a nozzle head through which a fluid is discharged, said nozzle head being provided with a first pushing portion and a second pushing portion;

an intermediate portion slidably connected to the nozzle head, said intermediate portion comprising an outflow valve mechanism which opens when being pressed downward, wherein when the nozzle head is pressed downward, the first pushing portion presses the outflow mechanism to open;

an inflow valve mechanism which opens when being pressed upward; and bellows connecting the outflow valve mechanism and the inflow valve mechanism, wherein when the nozzle head is further pressed after the outflow valve mechanism is open, the second pushing portion pushes the intermediate portion downward to deform the bellows from a stretched position to a folded-up position, and wherein when the nozzle head is released, the bellows is restored from the folded-up position to the stretched position whereby the inflow valve mechanism is open and a fluid flows into the bellows.

2. The fluid discharge pump according to claim 1, wherein the outflow valve mechanism comprises (i) a valve seat having an opening portion through which the fluid flows, and (ii) a valve body comprising a ring-shaped supporting portion, a valve portion for closing and opening the opening portion, and multiple coupling portions connecting said supporting portion and said valve portion, said supporting portion being disposed upstream of the valve seat, wherein the first pushing portion pushes the valve portion downward to move the valve portion away from the valve seat when the nozzle head is pressed.

3. The fluid discharge pump according to claim 1, wherein the inflow valve mechanism comprises (i) a valve seat having an opening portion through which the fluid flows, and (ii) a valve body comprising a ring-shaped supporting portion, a valve portion for closing and opening the opening portion, and multiple coupling portions connecting said supporting portion and said valve portion, said supporting portion being disposed downstream of the valve seat.

4. The fluid discharge pump according to claim 1, wherein said bellows is restored from the folded-up position to the stretched position by its own elastic force.

5. The fluid discharge pump according to claim 1, further comprising a spring which restores the bellows from the folded-up position to the stretched position.

6. The fluid discharge pump according to claim 1, wherein the first pushing portion, the outflow valve mechanism, the bellows, and the inflow valve mechanism are disposed co-axially.

7. The fluid discharge pump according to claim 1, wherein the first pushing portion is hollow and constitutes a part of a fluid passage.

8. The fluid discharge pump according to claim 7, wherein the first pushing portion comprises an annular flange extending to an inner wall of the intermediate portion, wherein a fluid downstream of the outflow valve mechanism is in contact with the annular flange, the inner wall of the intermediate portion, and an interior of the first pushing portion.

9. The fluid discharge pump according to claim 1, wherein the first pushing portion is a stick-like member.

10. The fluid discharge pump according to claim 9, further comprising second bellows connected to the outflow valve mechanism and an inner wall of the nozzle head, wherein a fluid downstream of the outflow valve mechanism is in contact with the second bellows and the inner wall of the nozzle head.

11. The fluid discharge pump according to claim 2, wherein the valve seat is integrally formed with the intermediate portion.

12. The fluid discharge pump according to claim 1, wherein the inflow valve mechanism is connected to a housing adapted to be connected to a liquid dispensing port of the fluid-storing portion.

13. The fluid discharge pump according to claim 12, wherein a valve seat is integrally formed with the housing.

14. The fluid discharge pump according to claim 1, wherein the intermediate portion is slidable along an inner wall of the second pushing portion.

15. The fluid discharge pump according to claim 1, wherein the outflow valve mechanism, the inflow valve mechanism, and the bellows are made of a resin.

16. A fluid-storing container comprising a container having a fluid dispensing port, and the fluid discharge pump of claim 1 attached to the fluid dispensing port.

17. The fluid-storing container according to claim 16, further comprising a piston which is disposed inside the container at its bottom and moves up as the fluid inside is discharged.

* * * * *